US011344108B2

(12) United States Patent
Ashley

(10) Patent No.: US 11,344,108 B2
(45) Date of Patent: May 31, 2022

(54) BRUSH

(71) Applicant: Double Take Limited, Buckinghamshire (GB)

(72) Inventor: Matilda Elvira Filippa Ashley, London (GB)

(73) Assignee: Double Take Limited, Burnham (GB)

( * ) Notice: Subject to any disclaimer, the term of this patent is extended or adjusted under 35 U.S.C. 154(b) by 6 days.

(21) Appl. No.: 16/964,321

(22) PCT Filed: Jan. 21, 2019

(86) PCT No.: PCT/IB2019/000020

§ 371 (c)(1),
(2) Date: Jul. 23, 2020

(87) PCT Pub. No.: WO2019/145779

PCT Pub. Date: Aug. 1, 2019

(65) Prior Publication Data

US 2021/0037958 A1 Feb. 11, 2021

(30) Foreign Application Priority Data

Jan. 25, 2018 (GB) ..... 1801247

(51) Int. Cl.
*A46B 5/00* (2006.01)
*B43K 23/06* (2006.01)

(52) U.S. Cl.
CPC ..... *A46B 5/0041* (2013.01); *A46B 5/0008* (2013.01); *A46B 5/0095* (2013.01); (Continued)

(58) Field of Classification Search
CPC ..... A46B 5/002; A46B 5/0008; A46B 5/0033; A46B 5/0041; A46B 5/0095
See application file for complete search history.

(56) References Cited

U.S. PATENT DOCUMENTS 2,850,753 A * 9/1958 Pelletier ..... A46B 11/001 15/185
2013/0206162 A1* 8/2013 Torres-Ortiz ..... A61C 15/043 132/309

(Continued)

FOREIGN PATENT DOCUMENTS

CN 102 019 792 A 4/2011
CN 203 713 305 U 7/2014

(Continued)

OTHER PUBLICATIONS

International Search Report dated May 7, 2019 for International Patent Application No. PCT/IB2019/000020.

*Primary Examiner* — J C Jacyna
(74) *Attorney, Agent, or Firm* — Howard M. Gitten; Lewis Brisbois Bisgaard & Smith LLP

(57) ABSTRACT

A brush comprising; a shaft having a first end forming a handle portion and a second end including a first part of a swivel mechanism; a brush holding part comprising a central body portion and at least one leg extending therefrom, the leg capable of holding or forming a brush; the central body portion further having a second part of a swivel mechanism and engageable with the first part of the swivel mechanism to form a swivel joint which is rotatable about a common axis in order that the leg may be positioned to extend beyond the second end of the shaft in order that the brush may be used by a user.

3 Claims, 6 Drawing Sheets

(52) U.S. Cl.
CPC ..... *B43K 23/06* (2013.01); *A46B 2200/1046* (2013.01); *A46B 2200/202* (2013.01)

(56) References Cited

U.S. PATENT DOCUMENTS

| | | | | |
|---|---|---|---|---|
| 2015/0055999 | A1* | 2/2015 | Lim | A46B 9/021 401/125 |
| 2015/0296964 | A1* | 10/2015 | Kim | A46B 5/0016 15/106 |
| 2017/0007092 | A1* | 1/2017 | Deveau | B25G 3/38 |
| 2017/0273447 | A1* | 9/2017 | Kim | A46B 5/0095 |

FOREIGN PATENT DOCUMENTS

| | | |
|---|---|---|
| CN | 105 459 670 A | 4/2016 |
| CN | 106 114 001 A | 11/2016 |

* cited by examiner

BRUSH

CROSS-REFERENCE TO RELATED APPLICATIONS

This application claims priority to International Patent Application Number PCT/M219/000020 with International filing date of Jan. 21, 2019 entitled AN IMPROVED BRUSH, which claims priority to GB Application Number 1801247.6 filed Jan. 25, 2018 entitled AN IMPROVED BRUSH, the contents of which are incorporated herein by reference.

The present invention relates to brushes and improvements therein. In particular, it relates to a brush assembly having one or more brush heads interchangeably mounted on the same handle.

It is well known that brushes are made with different types of head and bristle type, size, length and softness for different purposes. It is inconvenient to have to carry many different brushes each with its own handle since this can be bulky to transport and inconvenient in use.

An object of the present invention is to overcome at least some of the disadvantages of the prior art.

According to one aspect of the present invention there is provided a brush comprising; a shaft having a first end forming a handle portion and a second end including a first part of a swivel mechanism; a brush holding part comprising a central body portion and at least one arm extending therefrom, the arm capable of holding or forming a brush; the central body portion further having a second part of a swivel mechanism and engageable with the first part of the swivel mechanism to form a swivel joint which is rotatable about a common axis in order that the arm may be positioned to extend beyond the second end of the shaft in order that the brush may be used by a user.

A particular advantage of the present invention is that more than one brush head can be placed on the same handle and the brush head easily changed during use.

According to another aspect of the present invention there is provided a brush in which a brush holding element comprising a central body portion and has two arms extending therefrom, each arm capable of holding a brush.

According to another aspect of the present invention there is provided a brush in which a brush holding element comprising a central body portion and has three or more arms extending therefrom, each arm capable of holding a brush.

It will be apparent that it is convenient for the user to have multiple brush heads attached to the same handle, so enabling quick changes of brush head whilst not having to change the handle.

According to another aspect of the present invention there is provided a brush in which the axis of rotation of the swivel mechanism is perpendicular to an axis extending along the shaft.

According to another aspect of the present invention there is provided a brush holding element comprising a central body portion and has two arms extending therefrom, the arm capable of holding a brush Advantageously, the user only has to rotate an arm to change the brush head. It can be seen that for painters, modellers and make up purposes such quick changes of brush head would be very useful. For example, one type of brush head would be a fine or outlining type of head, the other could be a fuller brush head with more bristles and suitable for filling in larger areas.

According to another aspect of the present invention there is provided a brush in which the second end of the shaft and the brush holding part each include cooperating parts of a detent mechanism to restrict the rotation of the brush holding part with respect to the shaft.

According to another aspect of the present invention there is provided a brush in which the detent mechanism is either a protrusion on the shaft which cooperates with a recess on the brush holding element, or a protrusion on the brush holding element which cooperates with a recess on the shaft.

Advantageously, the detent mechanism provides a method of holding the brush firmly in place whilst it is being used, but is not so stiff, cumbersome or difficult to use that changing brush heads becomes inconvenient and slows the user in his work.

It has also been found that a brush head can usefully be protected when not in use by means of a cap or cover. One such cover mechanism is shown in Figure CC where it can be clearly seen that the cover covers the two brush heads shown. The protective cover will prevent the material already on the brush being lost or damaged when the brush is not us use, and will prevent the brush collecting stray or extraneous unwanted material.

The invention will now be described in greater detail with reference to the accompanying drawings, in which FIG. 1 shows a perspective view of the brush and handle assembly FIG. 2 shows a side view of the brush and handle assembly FIG. 3 shows a view with the brush holder and central body portion partially rotated FIG. 4 shows a detailed view of the central body portion and the brush holders FIG. 5 shows how the path of rotation of the brush holder FIG. 6 shows more detail of the arrangement of the central body portion and the brush holding parts FIG. 7 shows the central body portion and the brush holders separated from each other.

Figure 1:
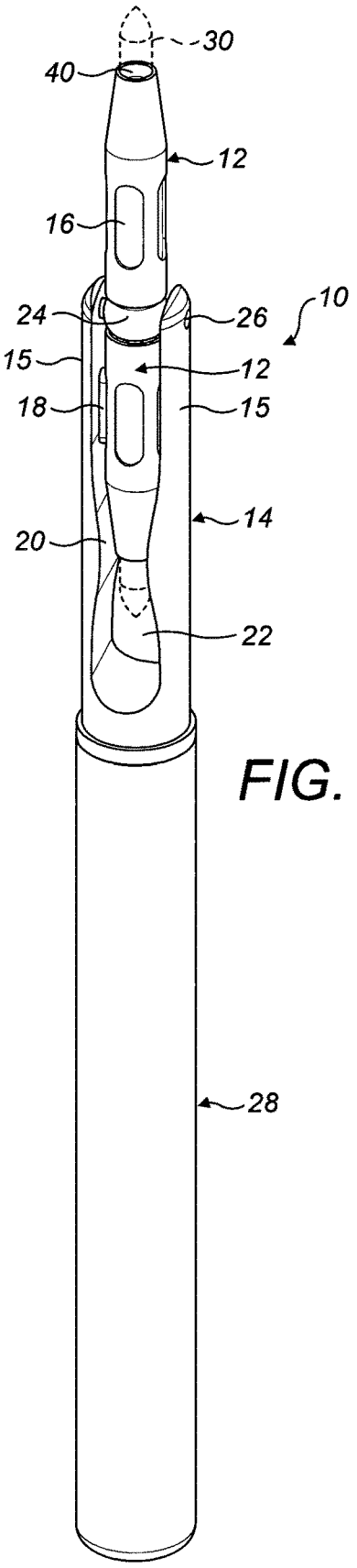

FIG. 1 shows the general arrangement of the whole brush assembly 10. The brush assembly 10 comprises a shaft forming a handle part 28 extending to a brush holding part 14. The brush holding part 14 extends from the handle and bifurcates to form two arms 15 which at distal ends located away from the handle comprise one part of a swivel joint. A central body portion 24 includes a second part of a swivel mechanism described in more detail below. A brush holding leg 12 is, at one end, attachable to and detachable from the central body portion 24. At or near an end 40 of the leg 12, remote from the central body portion is mounted a brush head 30. The brush head 30 (not shown in detail) may be a bristle brush, a sponge or any other desired form of brush or structure serving a similar purpose. The particular shape of the brush head can be chosen to suit the particular application. The central body portion 24 has pivot pins 26 extending from it on opposite sides of the body, the pins engaging with corresponding holes in the arms 15 of the brush holding part 14. An axis of rotation of the central body portion 24 and brush holding leg is defined by an axis extending through the pivot pins 26 and corresponding holes in the arms 15 of the brush holding part 14. In order to restrict rotation of the central body portion and brush holding leg 12 about the axis defined by the pins 26, a detent mechanism is provided. Protrusions or tabs 18 extending from the arms 15 of the brush holding part 14 cooperate with and engage in recesses 16 in the body of the brush holding leg 12. This ensures that as the brush holding leg 12 engages positively with the protrusion or tab 18 in the arm 15 when it is rotated and past the detent mechanism, so restricting unwanted movement. Alternatively, the brush holding leg 12 could be provided with small protrusions or tabs which engage with co-operating recesses in the arm 15 of the holding part 14.

Figure 2:
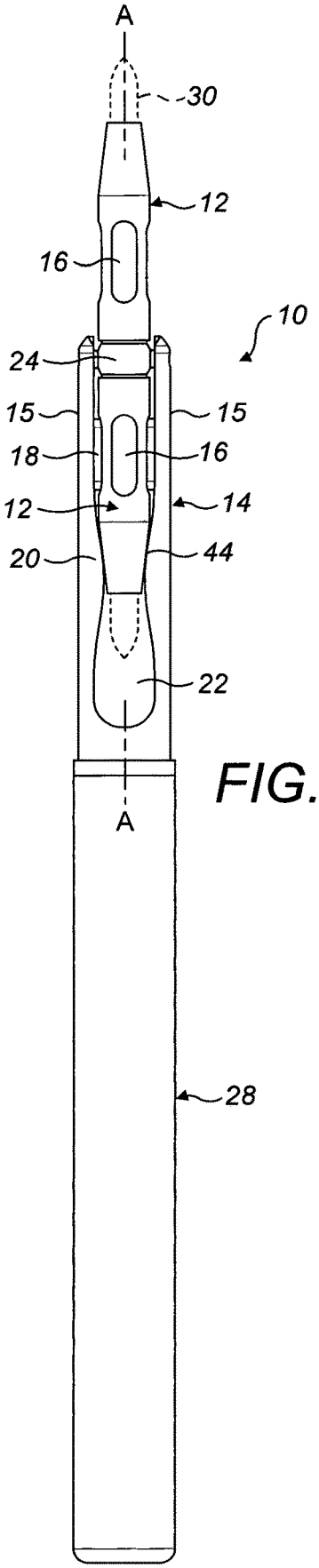

FIG. 2 shows a side view in greater detail. The brush assembly has a handle 28 which can be held by a user which extends to a brush holding part 14. The brush holding part extends from the handle to bifurcate, forming two arms 15. The central body portion 24 is pivotally mounted between the two arms 15. Extending from the central body part 24 are pivot pins, (not shown) to enable rotation of the brush holding legs 12. In this example only two legs are shown. It is possible for the central body to have three, four or more legs depending therefrom, each leg capable of supporting a brush. Near the base of the brush holding part 14 there is a recess 22 to allow the brush head not being used to be stored and at least be partially protected by the arms 15. The recess is as large as practical to enable large head brushes to be mounted on the leg.

Figure 3:
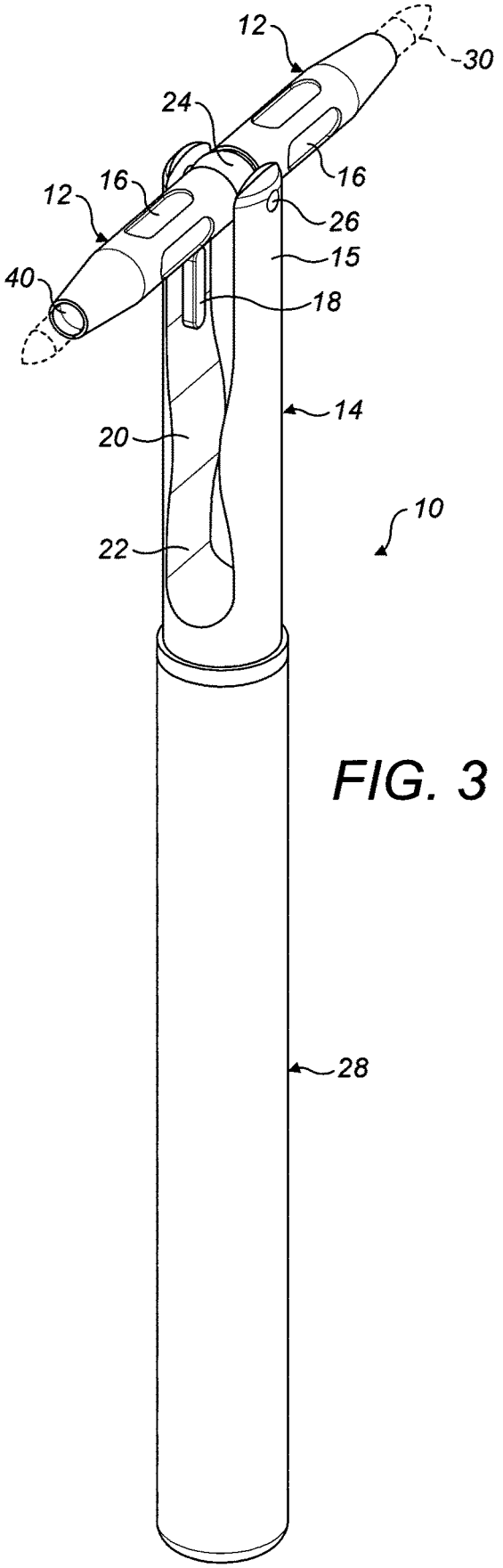

FIG. 3 shows the holder in an intermediate rotation position. Conveniently, the legs 12 may be provided with 4 indents spaced around the circumference. This is preferable if the leg 12 supports an asymmetrical style of brush. For example, if a brush is much wider than it is deep, as might be called a chisel head, and be used for writing gothic script, outlining a boundary in make-up or the like, it may be desirable to be able to rotate the leg 12 on the central body portion, so providing extra functionality.

Figure 4:
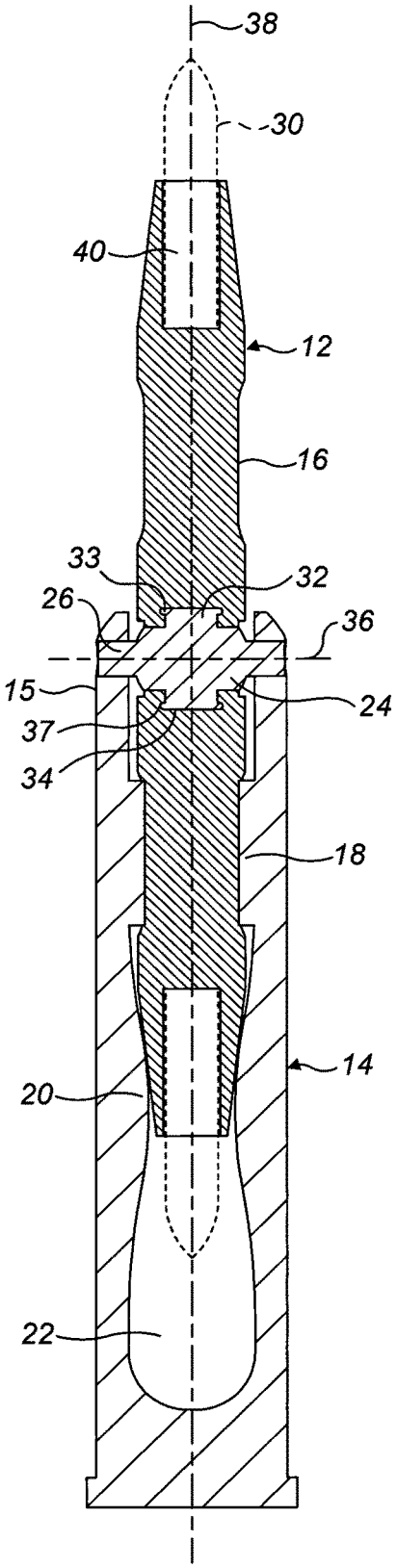

FIG. 4 shows a more detailed view of a possible assembly of the leg 12 on the central body part 24 and also the pivot arrangement. The central body part 24 has axial pins 26 extending from opposite sides thereof and defining an axis 36. Pins 26 engage in corresponding holes in the arms 15 to allow rotation about an axis 36. The arrangement shown is one of snap fit. Alternatively, arms 15 can be provided with one or more protruding pins in an arrangement which can engage in corresponding recesses in central body portion 24. The legs 12 can be secured to the central body portion by a number of different means, described in more detail with reference to FIG. 7 below.

Figure 5:
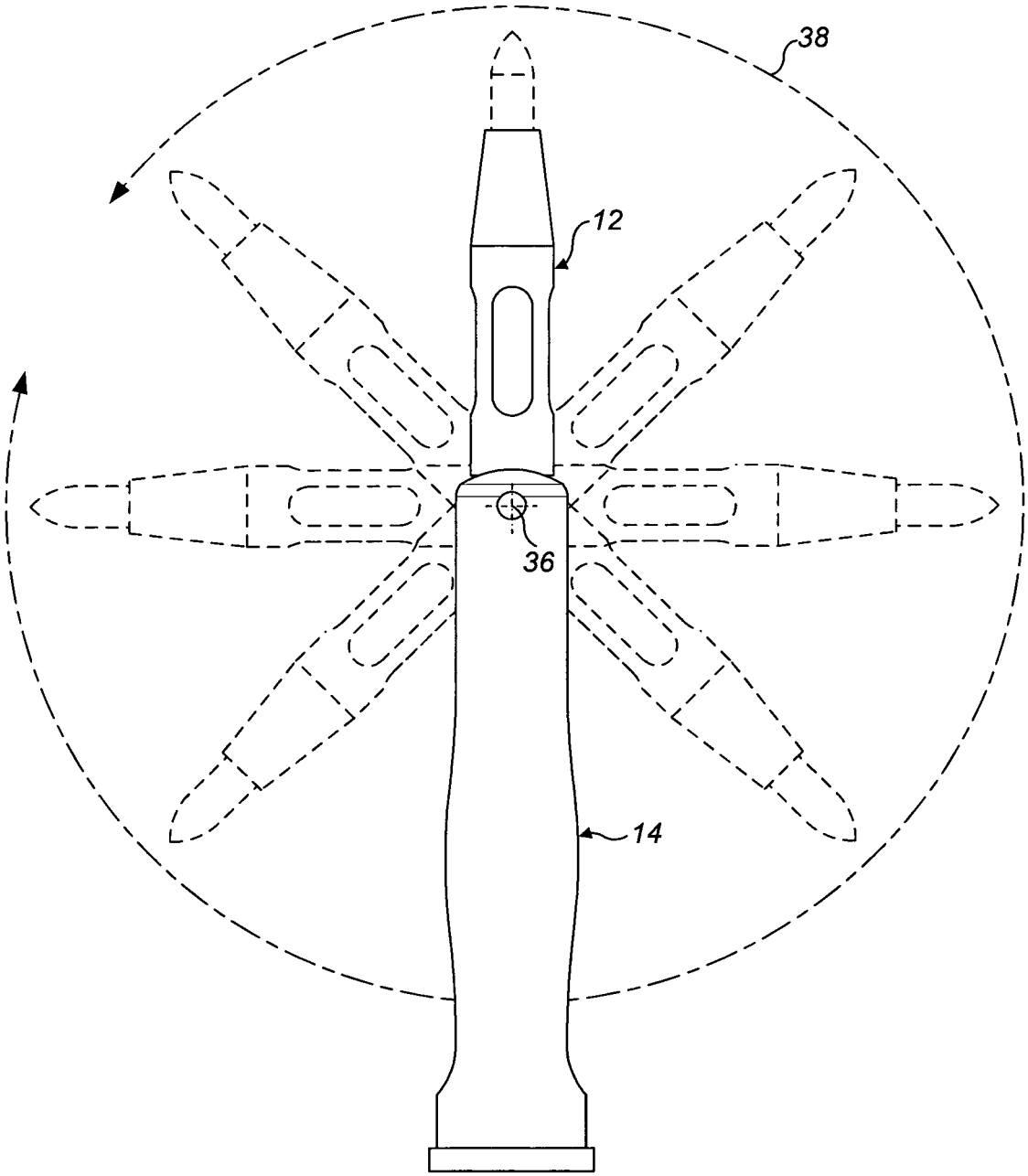

FIG. 5 shows an arc described by the leg 12 and brush holder when rotated about its axis 36. It is possible that the central body portion 24 could support more than 2 legs, although it is considered that four legs is a convenient maximum.

Figure 6:
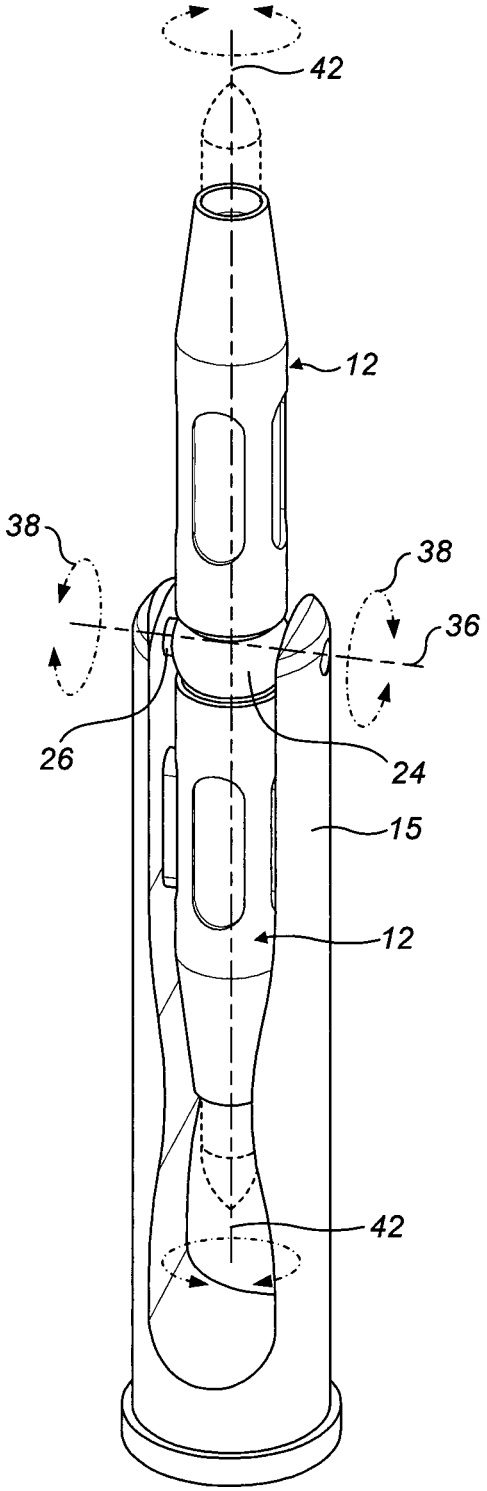

FIG. 6 shows the axis of rotation 36 of the central body part 24 and legs 12 in the arm 15. It also shows an axis of rotation 42 of leg 12 around the central body part 24. Rotation of the leg 12 around axis 42 enables a user to change the orientation of the brush on the handle or depending upon the type of fixing used to replace the leg or brush.

Figure 7:
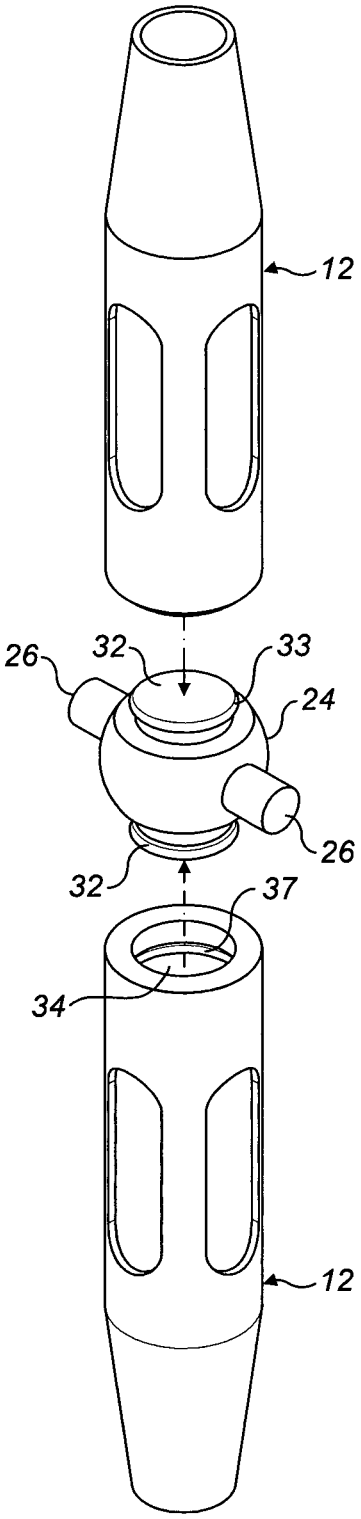

FIG. 7 shows the brush holding part separated into its major components. The central body part 24 is provided with pins 26 extending from opposite parts of the circumference of the body and which engage with cooperating recesses on the arms 15 to form the pivotal axis. Different means of securing legs 12 to the central body portion can be provided. Central body portion 24 has a raised portion 32 with a flange 33 at its outermost edge. Leg 12 includes a recessed portion 34 for receiving the raised portion 32, the recessed portion 34 has an additional recessed annular region 37 portion for receiving the flange 33. The leg can then be snapped into place over the raised portion 32 to secure the leg 12 to the central body 24. Alternatives can be readily envisaged, such as a flange located on the central body 24 extending around a part of the circumference which cooperates with a groove in the leg 12, to form a bayonet type coupling. In this manner the brush holder can be secured to the central body 24. It also enables the brush mounted on the leg to be changed for a different size or type of brush, or to be replaced.

Figure 8:
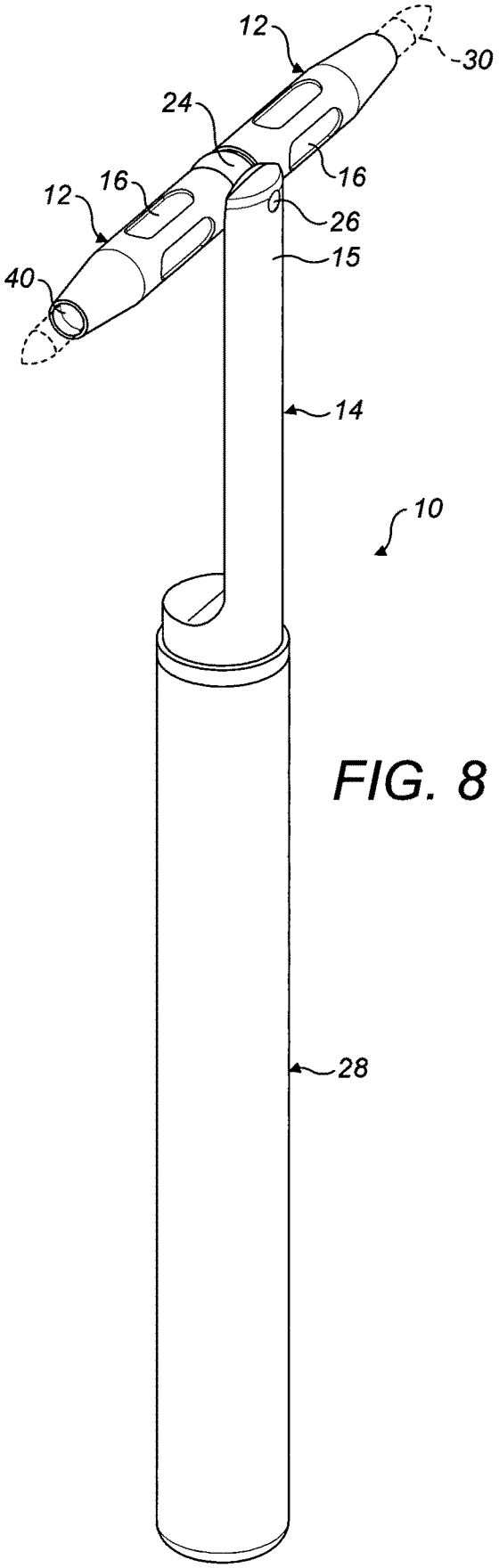
FIGS. 8 to 11 show various types of brush head which could be used in the holder.
Figure 9:
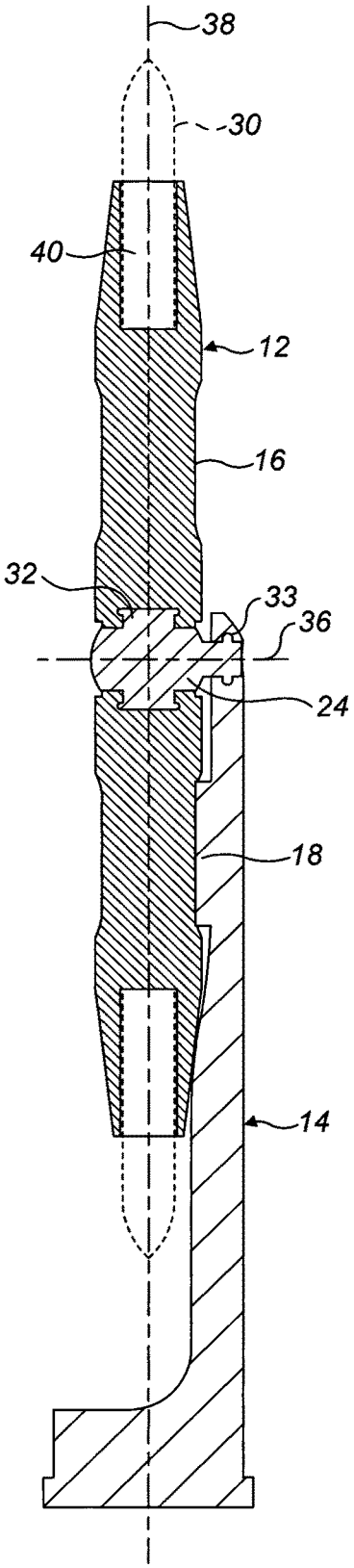
Figure 10:
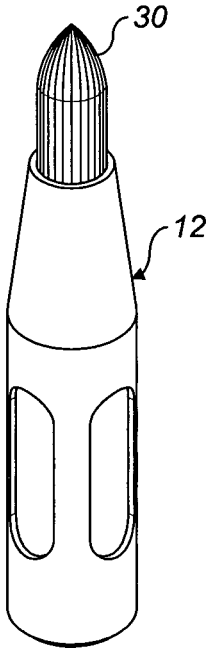
Figure 11:
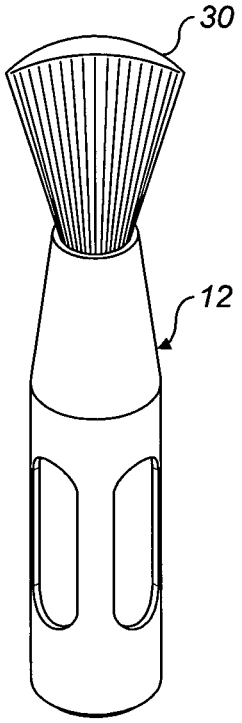

FIGS. 8 to 11 show a number of different types of brush heads which could be used in the assembly. The brush of FIG. 8 is particularly suitable for marking and outlining an area and could be used as an outliner in make-up. FIG. 9 shows a bush more suitable for covering a larger area, as a filling brush or a blending brush. FIGS. 10 and 11 show different types of brush, including a chamfered edge brush. Clearly many other types of brush could be used and the type will depend upon the particular application.

Figure 12:
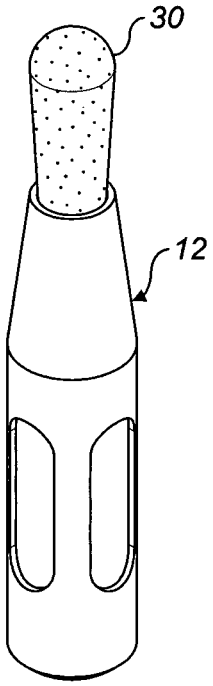
FIG. 12 shows an alternative method for mounting the brush holding part to the handle.
Figure 13:
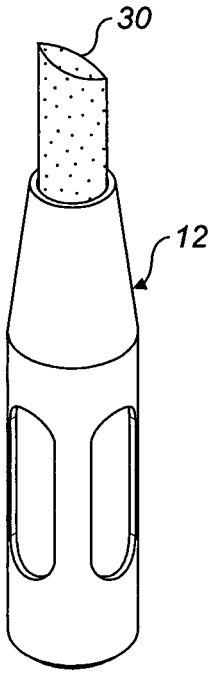
FIG. 13 shows a further alternative method for mounting the brush holding part to the handle.

FIG. 12 shows an alternative arrangement in which the handle extends to a brush holder, which at its end remote from the handle remains a single arm. The central body portion is connected to the arm to form a pivot means, enabling the legs to be rotated about an axis formed by the pivot joint.

The invention claimed is:

1. A brush comprising:

a shaft having a first end forming a handle portion and a second end, the second end including a first part of a swivel mechanism;

a brush holding part comprising a central body portion and at least one leg extending therefrom, the leg capable of at least one of one of holding or forming a brush;

the central body portion further comprising a second part of the swivel mechanism engageable with the first part of the swivel mechanism to form a swivel joint, the swivel joint being rotatable about a common axis which is perpendicular to an axis extending along the shaft in order that the leg may be positioned to extend beyond the second shaft end enabling the brush to be used by a user; and a detent mechanism located in a region at or near the second shaft end, and disposed on at least one of the central body portion and the brush holding leg, the detent mechanism including cooperating parts comprising one of a protrusion on or near the second shaft end which cooperates with a recess on the brush holding part, and a protrusion on the brush holding part which cooperates with a recess on the second shaft end; the brush holding leg is attachable to the central body portion by a snap-fit arrangement, the snap fit arrangement being formed by a flange part operatively engaging a recessed part so that the brush holding leg is detachable from the central body portion; and the brush holding leg is rotatable relative to the central body portion about an axis of rotation extending along the brush holding leg and through the central body part.

2. A brush according to claim 1, wherein the central body portion of the brush holding part has three or more legs extending therefrom, each leg capable of holding a brush.

3. A brush according to claim 2, wherein the second shaft end is bifurcated to form two arms, each arm having at or near their respective distal ends a first part of a swivel mechanism and engageable with the second part of the swivel mechanism on the central body portion to form a joint with the part of the swivel element on the arms.

* * * * *